US007178363B2

(12) United States Patent
Lagardere

(10) Patent No.: US 7,178,363 B2
(45) Date of Patent: Feb. 20, 2007

(54) ILLUMINATED AND FRAGRANCE-RELEASING JEWELRY DEVICE

(76) Inventor: Laetitia Lagardere, 206 rue Ste. Catherine F33000, Bordeaux (FR)

( * ) Notice: Subject to any disclaimer, the term of this patent is extended or adjusted under 35 U.S.C. 154(b) by 92 days.

(21) Appl. No.: 10/883,256

(22) Filed: Jul. 1, 2004

(65) Prior Publication Data

US 2004/0231360 A1 Nov. 25, 2004

(30) Foreign Application Priority Data

Jan. 2, 2002 (WO) ..... PCT/FR02/00002
Jan. 4, 2002 (FR) ..... 28 10856

(51) Int. Cl.
*A44C 15/00* (2006.01)

(52) U.S. Cl. ..... 63/1.15

(58) Field of Classification Search ..... 63/20, 63/40, DIG. 2, 1.15
See application file for complete search history.

(56) References Cited

U.S. PATENT DOCUMENTS

| | | | | |
|---|---|---|---|---|
| 2,058,274 | A * | 10/1936 | Vivaudou et al. | 63/14.6 |
| 4,009,381 | A * | 2/1977 | Schreiber et al. | 362/571 |
| 4,638,409 | A * | 1/1987 | Berman | 362/104 |
| 4,785,642 | A | 11/1988 | Chin et al. | |
| 5,018,053 | A | 5/1991 | Belknap et al. | |
| 5,722,166 | A * | 3/1998 | Voswinkel | 29/896.4 |
| 5,727,577 | A * | 3/1998 | Post | 132/275 |

FOREIGN PATENT DOCUMENTS

| | | |
|---|---|---|
| DE | 29814295 | 12/1998 |
| EP | 0945084 | 9/1999 |
| FR | 2220207 | 3/1973 |
| FR | 2581499 | 5/1985 |
| FR | 2585451 | 7/1985 |
| FR | 2616633 | 7/1987 |
| FR | 2695992 | 9/1992 |
| FR | 2762759 | 5/1997 |
| FR | 2810856 | 6/2000 |
| WO | WO 88/01360 | 5/1988 |
| WO | WO 94/18495 | 8/1994 |
| WO | WO 03/059112 | 7/2003 |

* cited by examiner

*Primary Examiner*—Jack W. Lavinder
(74) *Attorney, Agent, or Firm*—Innovation Law Group, Ltd.; Jacques M. Dullin, Esq.

(57) ABSTRACT

An attractive, decoratively interesting, wearable, light weight jewelry device having illumination and fragrance-emitting features. The preferred form is a brooch having one or more LEDs connected to an electric circuit fed by a micro-battery for a wide range of illumination effects, and more particularly effects where the emitted light flux is controlled and dimmed. The body of the brooch is porous to absorb fragrance essences so it emits any wearer-selected scent. The body has a cavity into which an inter-changeable, sealed light source unit is inserted with the LED projecting through the top face of the brooch. The light circuit preferably includes a chip that provides a wide range of programmed light displays, such as sequences of colors, scintillating, flashing, change in intensity (pulsing) and the like. The light display can be activated by remote control and the LED bezel may be prism shaped or have optical fibers secured thereto.

13 Claims, 2 Drawing Sheets

ILLUMINATED AND FRAGRANCE-RELEASING JEWELRY DEVICE

CROSS-REFERENCE TO RELATED APPLICATIONS

This application is the National Stage U.S. Application of prior PCT Application PCT/FR02/00002, filed by the same inventor on Jan. 2, 2002 under the same title, published by WIPO on Jul. 24, 2003 as document WO 03/059112, the priority of which is claimed under 35 US Code §§ 361–365. This application corresponds to French Application FR 2,810,856 filed on Jan. 4, 2002 by the same inventor under the same title.

FIELD

The present invention concerns an illuminated and fragrance-releasing jewelry device whose light flux is controllable and can be varied, and more particularly to a brooch having a recess for containing a removable insert containing a battery-powered illuminating LED and chip for providing a variety of illuminating sequences and effects, and the body of the brooch comprises an absorbent ceramic or other material to which a fragrance, perfume or essential oil may be applied for the slow release of the fragrance.

BACKGROUND

One of the characteristics of a jewelry device, other than its esthetic qualities, is to draw attention to itself which usually flatters the woman who wears it.

The quality and size of a solitaire are evident and costly proofs of the splendor of a diamond.

Accordingly, it is not surprising there have been studies that effectively demonstrate that a wearable jewelry device has become a decorative element. In order to accomplish this, prior art jewelry devices have been created that produce either light or fragrance.

Patent LOUCHAVESKY FR A 2 695 992 produces a lighting device destined for both interior decoration and for clothing. A bulb placed within a reflector concentrates light onto a fiber optic bundle.

WIPO Publication JANKO WO 88/01360 is a lighted device for clothing or wearable decorations. The lighting device is mounted on a extendable band attached to the garment. It is made up of a battery, a switch, electric conductors and electroluminescent diodes which selectively activate the lighting device.

Patent HUET FR A 2 581 499 shows an apparatus allowing a variation of light intensity by means of sound. There is a microphone, an amplification system and a light system which is especially designed to decorate clothing.

WIPO Publication WESTMOLAND WO 94/18495 shows an illuminated jewelry device. It comprises a body with two plate elements between which are sandwiched a battery and a light source connected electrically between the plate elements. A circuit element controls the light characteristics.

Patent JAKOBOVIC KRUNO FR A2 585 451 pertains to an ornamental device comprising at least one mechanism to emit light. The lighting apparatus consists of two diodes measuring light intensity, connected by a wire to an electronic module contained inside a case. The diodes emit light signals, modulated by a sound signal captured by a microphone.

Patent VIGNAUD FR 2 762 759 discloses as a jewelry device capable of diffusing a scent. A jewelry device is equipped with an ornamental element, comprised of "touch to release the scent" type of paper, which can absorb perfume.

Patent DI PATARCHI EP 9983017205 describes a jewelry device which contains a particular quantity of the scent inside a base from which it is possible to progressively diffuse the fragrance.

Thus, prior to the present invention, the two characteristics of light and fragrance have not been combined in the same device, and therefore, the present invention is directed to improving the prior art by providing a wide range of different possible combinations of those two features.

THE INVENTION

Summary, Including Objects and Advantages

It is among the objects and advantages of the invention to provide an attractive and decoratively interesting wearable jewelry device, such as a brooch, that utilizes electroluminescent diodes (LED) which are connected to an electric circuit fed by a micro-battery to provide a wide range of attractive illumination effects, and more particularly effects where the emitted light flux is controlled and dimmed. In addition, the inventive jewelry device includes provision for emission of fragrance that is not dependent on the emission of the light flux.

The present invention overcomes deficiencies of the prior art and provides illuminating and scent or fragrance emitting jewelry devices which are not burdensome (that is, awkward and heavy to wear), and which have wearer-selectable features that permit identifying the person wearing them.

The inventive jewelry device contains an interchangeable, sealed apparatus (light source), inserted into the body of the jewelry device that emits and modulates a luminous flux, while the material of the body of said jewelry device permits conserving and emitting the scent or fragrance, e.g., by being absorbent.

It is preferred that the illuminating light source insert apparatus contains a visible diode (LED) operated by an electric circuit fed by a button-type battery which permits providing various colors of light to be emitted.

According to one embodiment of the invention, the emitted light flux is transmitted to at least one optic fiber. Advantageously, the emitted light comprises fixed and constant colors. According to a preferred embodiment, the emitted light comprises a series of automatically changing colors. In still another embodiment, the emitted light comprises programmable colors. Preferably, the light is emitted periodically. According to another embodiment of the jewelry device, the emission of light is activated and controlled by remote control.

Advantageously, the inventive luminous and fragrance-emitting jewelry device contains a lower internal permeable wall (back or bottom face) which permits expelling the perfume, e.g., by diffusion or evaporation, that was previously injected into the brooch and an upper internal wall (top face) that is sealed, e.g., protected by a varnish. The electric circuit is preferably powered by a rechargeable battery. In accordance with still another embodiment, a prism diffracts the light emitted by the electroluminescent diode.

Thus, the inventive luminous and fragrance-emitting jewelry device emits a display of light of different colors, these colors being fixed and constant, or programmable, or automatically changing in succession. The light display can be emitted periodically or by actuation of a remote control. This light display can be equally transmitted by optic fibers. The previously injected scent can be expelled.

Characteristics of the illuminated flux, other than its decorative and esthetic aspects, permit the identification of the person who chooses them. As in the manner of Tahitians, who wear a Tiaré flower over one or the other ear, according to whether they are single or married, it is possible to wear the brooch lighted green or red, fixed or scintillating, programmed, or remote controlled. It suffices for the wearer to preselect the identifying characteristic, then to display it in order to be recognized. Thus, the inventive jewelry device responds well to fixed choices of the wearer, that is, a choice that is or becomes fixed in the mind of the wearer as significant and identifying.

BRIEF DESCRIPTION OF DRAWINGS

Other characteristics and advantages of the invention will be apparent from a reading of the detailed description of exemplary modes of realizing the jewelry device, in reference to the attached drawings, by way of example but not by limitation.

DETAILED DESCRIPTION, INCLUDING THE BEST MODE OF CARRYING OUT THE INVENTIONS

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

All publications, patents and applications cited in this specification are herein incorporated by reference as if each individual publication, patent or application had been expressly reproduced herein.

Figure 1A:
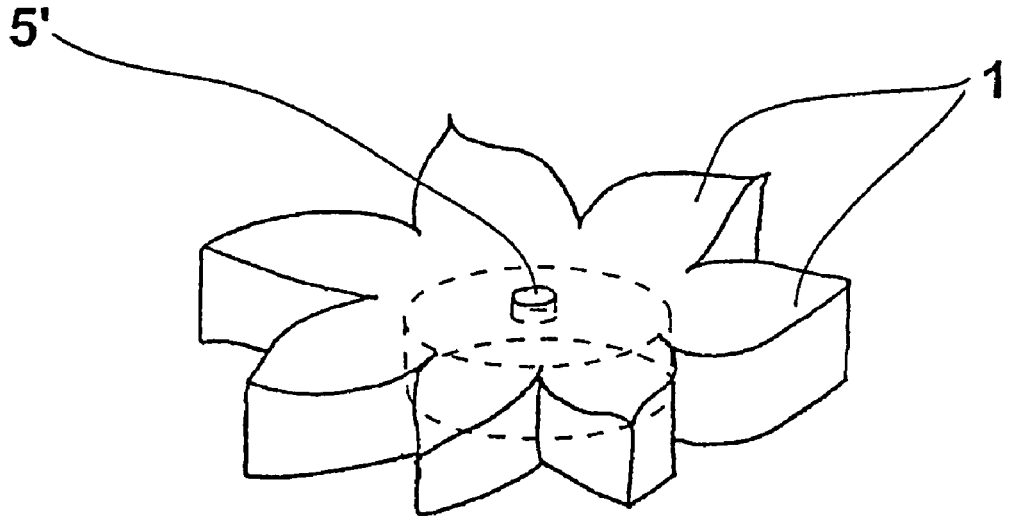
FIG. 1A is a schematic view, from an elevated perspective, of the top of the jewelry device, but without its insert apparatus for emitting light.
Figure 1B:
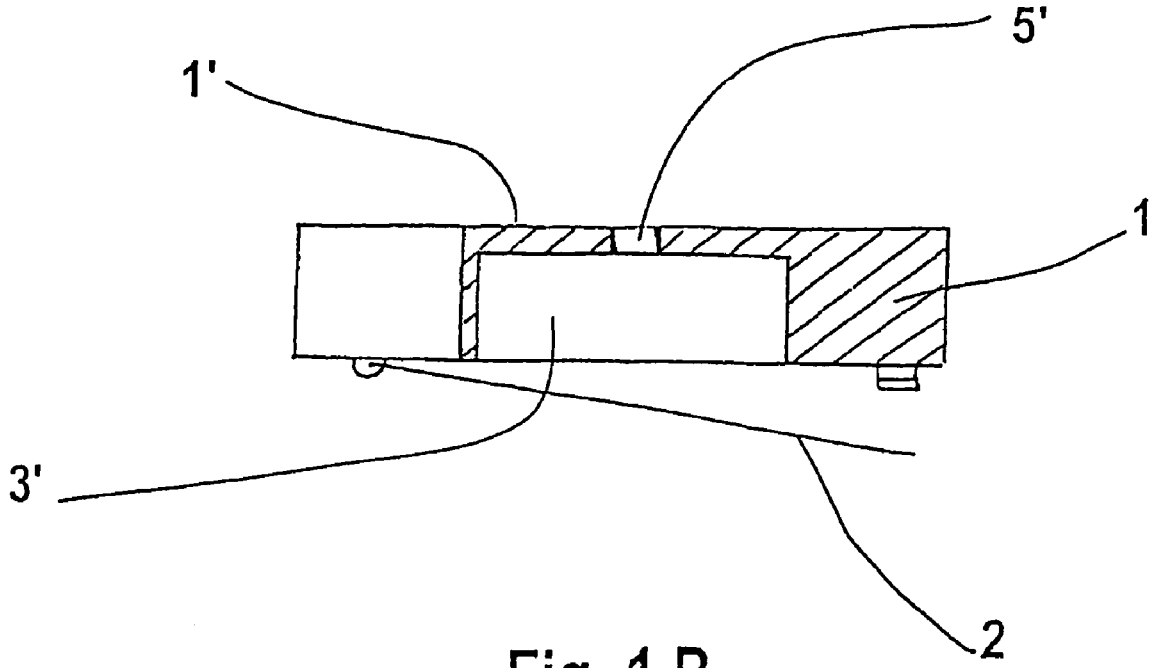
FIG. 1B is a schematic side section view of the jewelry device in the same configuration as FIG. 1A.

There is represented in both FIGS. 1 and 1A the body of the bare jewelry device, not equipped with the light-emitting insert apparatus (light source insert). FIG. 1A is a schematic of the device in an elevated perspective; FIG. 1B is a schematic section view.

The inventive jewelry device, in accord with an illustrative embodiment, is a pin (brooch) in the form of a flower whose body 1 is made of a porous material such as porcelain. This brooch is held onto clothing by a pin 2. The body carries a cavity 3' in which can be inserted the light-emitting apparatus 3. That cavity 3' is pierced in the center by a measured hole 5', sized to receive the electroluminescent diode 5 (LED) of apparatus 3 for the emission of the light.

A layer of varnish or other suitable impervious sealant 1' coated on the upper surface (the face) permits conservation and slow release of the chosen scent or fragrance applied onto the bottom face of the body of the brooch.

Figure 2A:
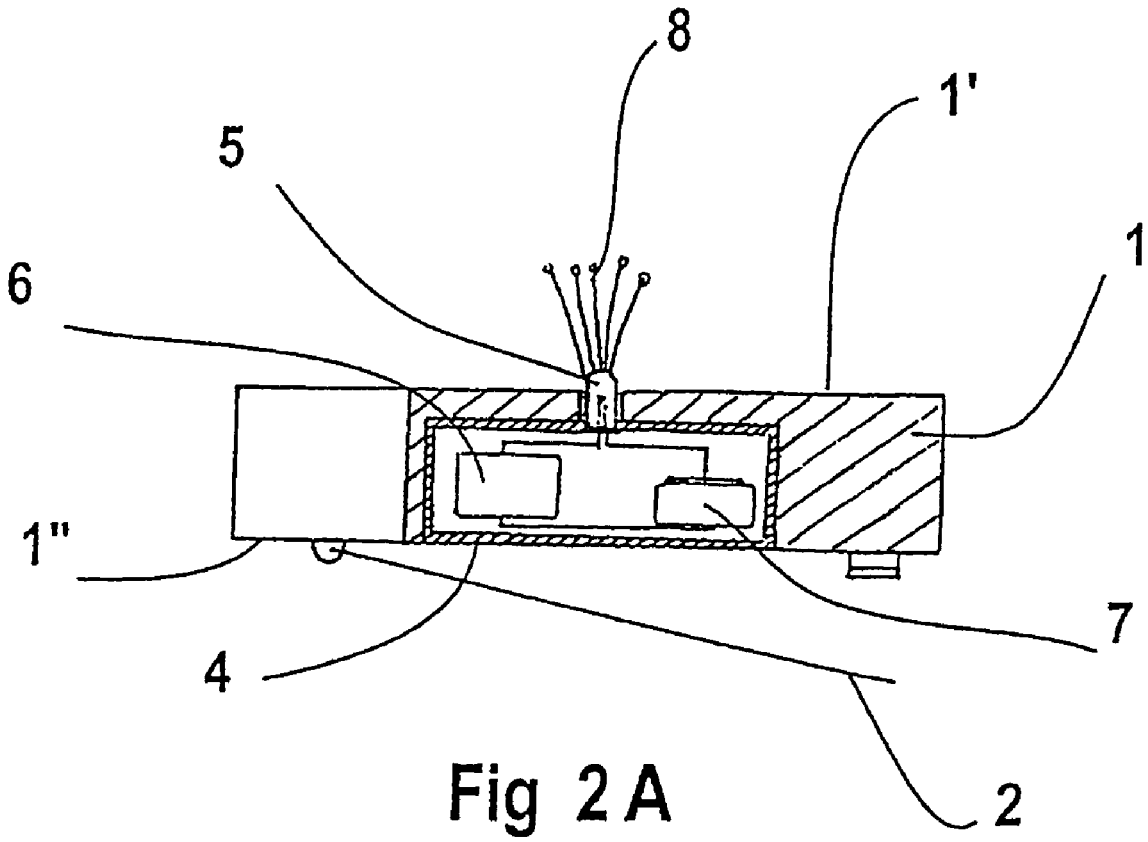
FIG. 2A is a schematic side section view of the jewelry device containing its apparatus for emitting the light display.
Figure 2B:
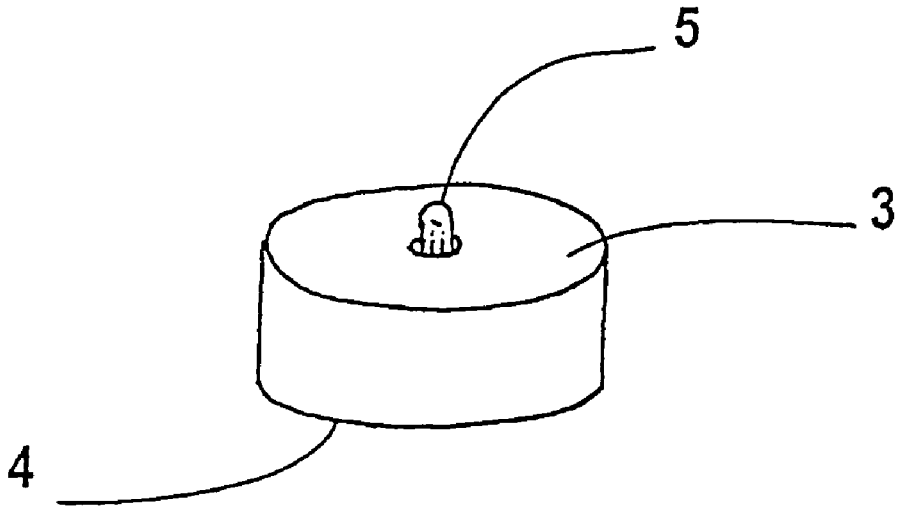
FIG. 2B is a schematic, elevated perspective view of the light-emitting apparatus insert.

FIG. 2A shows in a schematic section view, the brooch furnished with its light-emitting apparatus, and in FIG. 2B this apparatus is represented schematically in an elevated perspective view.

The light source insert apparatus 3 is protected by a flexible envelope 4, assuring impermeability and permitting it to be secured in the cavity 3'.

The light-emitting apparatus comprises an electronic circuit card 6 powered by a button-type battery or a rechargeable battery 7. The light is emitted by an electroluminescent diode 5 (LED), projecting through cylinder bore 5', shown in the center of the brooch. Optic fibers 8 can transport the flux of light to differing points. By way of example they may be glued to the clear or colored plastic lens or bezel of the LED.

The light-emitting insert is interchangeable; thus, it is possible to obtain different colors or obtain permanent colors. This variety of possibilities is augmented by electronic circuit card 6 capable of providing varying functions, such as: a column (or sequence) of colors; glimmering (scintillating) display; or remotely controlled (e.g., ON/OFF, color sequences or flashes, etc.). The combination of interchangeability and of diverse assorted functions opens up numerous display choices by the selection of the brooch's owner.

Thus, the inventive brooch can be a sign of distinction, of recognition by virtue of the wide range of fragrance possibilities. In addition, the light displays are numerous and depend on the imagination and interest carried to the brooch as a means of attaining them.

The fragrance function is, then, a complementary combination provided to the wearing of a unique brooch. According to the invention, the brooch answers well to fixed objects.

Modifications are susceptible of being exercised by one skilled in the art of jewelry devices, which, without altering the original apparatus, would merely be self-evident, equivalent variations, well within the scope of the present invention. For example, the plastic bezel of the LED may be formed into or have secured thereto a prism to refract the light. A plurality of different small LEDs may be arrayed in the illumination insert to provide multiple colors for the displays. The circuit preferably includes a chip that can provide a pre-programmed, user selectable range of light displays, including pulsing in intensity, timed, scintillating or flashing, sequences of colors, random color displays and the like. Such chips are well known to those skilled in the art of LED and fiber illumination. Similarly remote activation receivers are well know and may be included in the illumination insert capsule. The scents may be provide by a wide range of fragrance-containing essences or compositions, including essential oils, perfumes, eau de toilette, herbal tinctures and the like. The fragrances emitted by the inventive jewelry device may be selected to provide important, well-recognized aroma-therapy benefits, such as calming influences, mood enhancers, enhancement of breating, medicinals, pleasant food odors, and the like, e.g., lavender oil, coffee or vanilla extracts, etc.

What invention claimed is:

1. Illuminated and fragrance-emitting jewelry device, comprising:

a) a wearable body of porous, absorbent material having a front and a back face, and a cavity for receiving an illumination insert;

b) an illumination insert comprising an interchangeable, impermeable apparatus that is removably insertable into said cavity in the body of the device, said illumination insert including a light element, a power source and a circuit to emit and control light emitted from said light element:

c) said body having at least one aperture through which said light may be emitted;

d) said back face includes an exposed area in which the porous material of the body of said device is exposed for receiving thereto, and being absorbed therein, an amount of fragrant material comprising a fragrance or scent material, composition, essence or compound; and e) said front face is coated with an impervious material to slow the emission of a scent provided by said fragrant material, wherein the absorbent nature of said body material serving as a reservoir that retains and emits over time a scent from said fragrant material absorbed in said body material through said exposed area.

2. Illuminated and fragrance-emitting jewelry device as in claim 1 wherein said illumination insert contains an LED assembly operated by a circuit powered by a button-type battery, said LED assembly having the capability of emitting at least one color of light.

3. Illuminated and fragrance-emitting jewelry device as in claim 2, which includes at least one optic fiber secured to the outer surface of said LED assembly so that light is transmitted to said at least one optic fiber.

4. Illuminated and fragrance-emitting jewelry device as in claim 2 which includes a pin on the back face to secure said device to clothing.

5. Illuminated and fragrance-emitting jewelry device as in claim 4, wherein said device is a brooch.

6. Illuminated and fragrance-emitting jewelry device as in claim 5 wherein at least a portion of said body is porcelain to provide absorbency for a fragrance providing material.

7. Illuminated and fragrance-emitting jewelry device as in claim 6 wherein the fragrance providing material is selected for aroma-therapeutic effects.

8. Illuminated and fragrance-emitting jewelry device as in claim 1 wherein the emitted light includes fixed and constant colors.

9. Illuminated and fragrance-emitting jewelry as in claim 8, wherein the emitted light includes automatic display of colors in a group.

10. Illuminated and fragrance-emitting jewelry device as in claim 1, wherein said circuit includes a programmable chip to provide a selectable program of light color display.

11. Illuminated and fragrance-emitting jewelry device as in claim 9, wherein the emitted light is emitted periodically.

12. Illuminated and fragrance-emitting jewelry device as in claim 10 wherein said circuit includes means for actuating said light emission by remote control.

13. Illuminated and fragrance-emitting jewelry device as in claim 1 which includes a prism and wherein said light it transmitted to said prism to diffract the light.

* * * * *